United States Patent [19]

Otsuki et al.

[11] 4,015,415

[45] Apr. 5, 1977

[54] TWISTING MACHINE

[76] Inventors: Shoji Otsuki, 25, 10-Banchi, 4-Chome, Higashi Shinmachi, Yao, Osaka; Kenjiro Kuroishi, 399-Go, 4-Ban, Nishi-1-Chome, Shiki-Cho, Yao, Osaka; Eiji Ohara, 49, 1-Ban, 4-Chome, Kathuyamakita, Ikuno, Osaka, Osaka, all of Japan

[22] Filed: Aug. 5, 1975

[21] Appl. No.: 602,066

[52] U.S. Cl. ..... 57/34 R; 57/13; 57/161

[51] Int. Cl.[2] ..... D07B 3/04

[58] Field of Search ..... 57/34 R, 3, 6, 13, 14–18, 57/58.3, 58.36, 58.38, 58.49–58.55, 58.83, 58.86, 59, 62, 63, 64, 100, 106, 115, 116, 127.5, 160

[56] References Cited

UNITED STATES PATENTS

| | | | |
|---|---|---|---|
| 2,566,973 | 9/1951 | Yoke | 57/13 X |
| 2,826,035 | 3/1958 | Cogger | 57/127.5 X |
| 3,110,999 | 11/1963 | Pilczuk | 57/16 X |
| 3,382,655 | 5/1968 | Wasserman | 57/160 X |
| 3,643,416 | 2/1972 | Andrews et al. | 57/160 X |
| 3,827,225 | 8/1974 | Schoerner | 57/13 |

*Primary Examiner*—Donald E. Watkins
*Attorney, Agent, or Firm*—Bacon & Thomas

[57] ABSTRACT

This invention provides an intertwisting means including drum rotatable about the axis thereof to feed linear objects wound thereon through arm members suspended over the periphery of the drum in rotatable relation with the axis thereof so as to guide the fed objects into an inner hollow portion of the drums by means of guide rollers.

The invention further involves the construction formed with cap means for intertwisting the guided objects at an equal angle of torsion thereby to form a continuity of thick, strong rope-like object and a means for automatically winding said continuity thereon.

5 Claims, 4 Drawing Figures

TWISTING MACHINE

The present invention relates generally to improvements in a twiner and more particularly to an improved twisting machine for intertwining hemp, fibre or wire (hereinafter called merely "a linear object") thereby to form a continuity of line, for intertwining a plurality of small diameter lines to form a strand, or for further twining the strands together into a continuity of thick, strong rope-like object.

Generally, there have been known two conventional type twisting machines — a tube type and a gauge type. Of these two, the tube type twisting machine is composed of a movable hollow tubular body provided internally with a plurality of drums which are wound for example with wires and disposed in parallelism with each other in a manner to traverse perpendicularly to a rotary shaft of said tube, staying stationary without rotating along with the movement of the tubular body so that the wire being drawn out of each drum is guided to the inner peripheral wall of the body until it reaches one end of the body: This has the result that the wire drawn out of each drum is intertwined uniformly with equal torsion by the movement of the tubular body.

According to the tube type twisting machine constructed in the above-mentioned manner, however, the wire drawn out of each drum is easily subjected to a centrifugal force caused by the movement of the tubular body and forcibly pressed against the inner peripheral wall thereof, consequently the wire per se being liable to get distortedly kinked. For this reason, when the kinked wires are intertwined to form a single length of rope-like object, they cause an inner strain giving rise to weakness of the object thus formed.

Inasmuch as the aforesaid drums are disposed in parallel relation with each other along the inner peripheral surface area of the tubular body, they are dimensionally restricted within the area so that a linear object to be intertwined by means of the tube type twisting machine must be rewound onto the drums of particular size.

Further the trouble with this type is that the forcible movement of the large size tubular body creates much noise and the unbalanced weight of each drum having a different quantity of linear object wound thereon gives rise to unavoidable vibrations. In addition, due to the mechanical construction of the tubular body adapted to support the drums in suspension in predetermined inner hollow portions of the body, each operation of mounting the drums to these portions and dismounting the same therefrom are often impeded by the construction per se, consequently taking a long time to carry out each operation.

The gauge type twisting machine already mentioned in the foregoing is such that a plurality of drums are mounted over the outer peripheral surface of a large size rotary body in a manner to orient the axis of each drum in parallel relation to the vertical plane axially of the body and permit the drums to rotate only about the axis of the body thereby intertwining the linear objects from the drums.

According to this type, each linear object drawn from the drums may be prevented from being kinked. However, the size of the machinery is too large to be equipped easily in a limited space.

Moreover, even though the drums are providently disposed in balanceably weighed portions, they cannot always be supported in such a manner that balanced weight is equally distributed in the peripheral direction of the rotary body, thus causing vibrations and consequent cacaphony to the drums.

Accordingly, the present invention has been designed to liminate all of the above-mentioned drawbacks and disadvantages of the conventional twisting machines by providing an improved novel mechanism that comprises drums supported thereon in a manner to permit linear objects to be drawn out of the drums by the movement thereof, rotary arm members disposed over the periphery of the drums so as to rotate about the axis of a rotary shaft supporting the drums thereby inducing the linear objects to be drawn out of the drums during the course of rotation, guide means to guide the linear objects from the rotary arm members toward the axis of the inner hollow portion of the drums, and a metallic cap for intertwisting a plurality of linear objects guided into the cap by means of guide means.

One of the main purposes of the present invention is the provision of a twisting machine that does not allow a linear object from a drum to be distortedly twisted.

Another purpose of the invention is to provide a machine wherein the drums are adapted to rotate without causing great centrifugal force that would act on the linear objects when the latter are being fed to a metallic cap of the machine thereby preventing the linear objects from being distortedly twisted.

A further purpose of the invention is to provide a machine wherein the drums wound with linear objects can easily be mounted and dismounted.

A still further purpose of the invention is to provide a machine wherein the drums can rotate to twist the linear objects together without causing vibrations and consequent cacophony.

A still further purpose of the invention is to provide a machine wherein the drums originally wound with linear objects can be easily mounted in limited space.

These and other purposes, features and advantages of the invention will become apparent from the following detailed description when taken in conjunction with the accompanying drawings showing a few preferred embodiments of the invention, in which.

Figure 1:
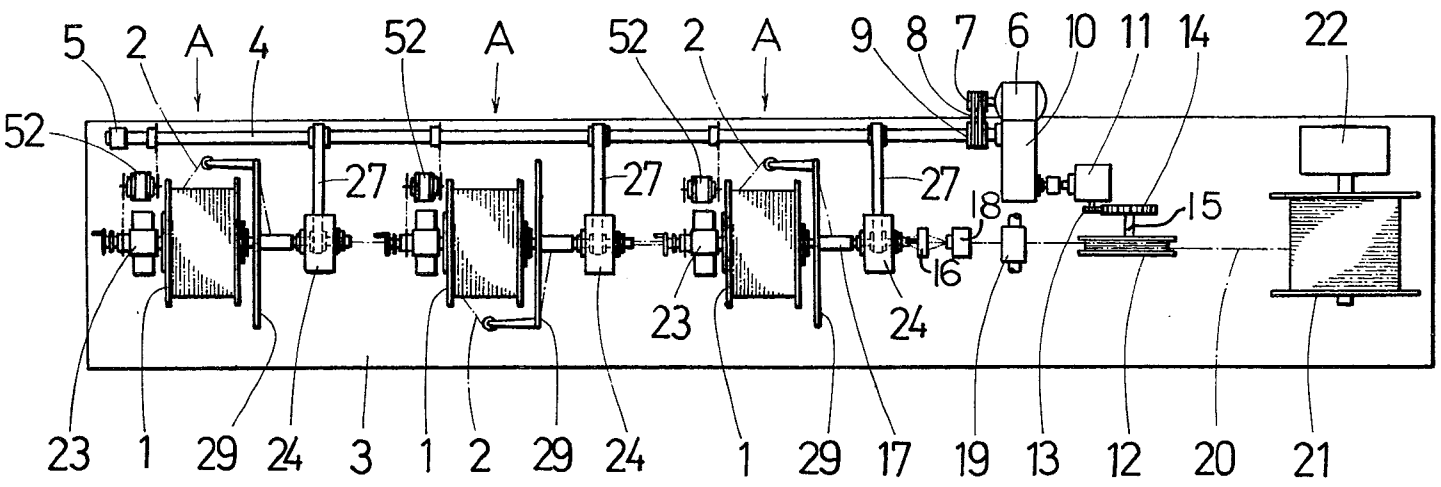
FIG. 1 is a top plan view showing a twisting machine embodied in accordance with the invention.

Referring now to the accompanying drawings, and first more particularly to FIG. 1, the reference character A generally designates a twisting machine of the invention. Said machine A is mainly composed of drums 1 each wound with a linear object 2 and mounted on a platform 3 in positions to be axially aligned with each other.

A main shaft 4 is positioned at one side of said platform 3 in parallel relation with the axial direction thereof and rotatably supported by means of suitable bearing members 5. Said main shaft 4 is driven from an electric motor 6 through a pulley member 7, a belt 8 and a pulley member 9.

The numeral 10 denotes a first reduction mechanism connected to said main shaft portion 4 at the side of the motor 6 so as to suitably reduce the driving force thereof. The driving force thus reduced by means of the first reduction mechanism is transmitted to a second reduction mechanism 11 to drive a drawing drum 12 through a small diameter gear 13 and a large diameter gear 14 intermeshingly engaged therewith.

Said drawing drum 12 is fixedly supported on a shaft member 15 of said large diameter gear 14 transverse to the axis of each drum 1 mounted on the platform 3 and adapted to be rotated at a fixed ratio thereto by said gears 13, 14, intermeshingly engaged with one another.

Between the drawing drum 12 and one of the drums 1 directly adjacent thereto a rotatable metallic cap 16 is mounted on one end of a rotary shaft 17 supporting said adjacent drum 1; Between said drawing drum 12 and said rotatable metallic cap 16 there is rigidly mounted a fixed metallic cap 18, and between said drawing drum 12 and this cap 18 there are mounted guide rollers 19 whereby the linear objects 2 from the drums 1 are twisted together by said rotatable metallic cap 16 to form a continuity of rope-like object 20; Thereafter said continuity being fed to the drawing drum 12 and wound several times on the outer periphery thereof to form at least a single layer on said surface.

Since said drawing drum 12 is normally rotatable at a uniform rotary speed ratio, said rope-like object 20 is fed thereto from the drums 1 at a uniform speed. Thus, the rotatable metallic cap 16 is rotated at a fixed rotary speed ratio to that of the drawing drum 12 to result in the rope-like object 20 being normally intertwisted at a determined angle of twist.

The rotary speed of the drawing drum 12 is selectively adjustable by providing said first and second reduction mechanisms 10, 11 which can controllably change the reduction ratio in order to adjust the twist angle of the rope-like object 20 as desired. Thereafter, the rope-like object 20 thus drawn off of the drawing drum 12 is wound onto a winding drum 21 rotated by means of a suitable driving source 22 shown in the drawings.

Figure 2:
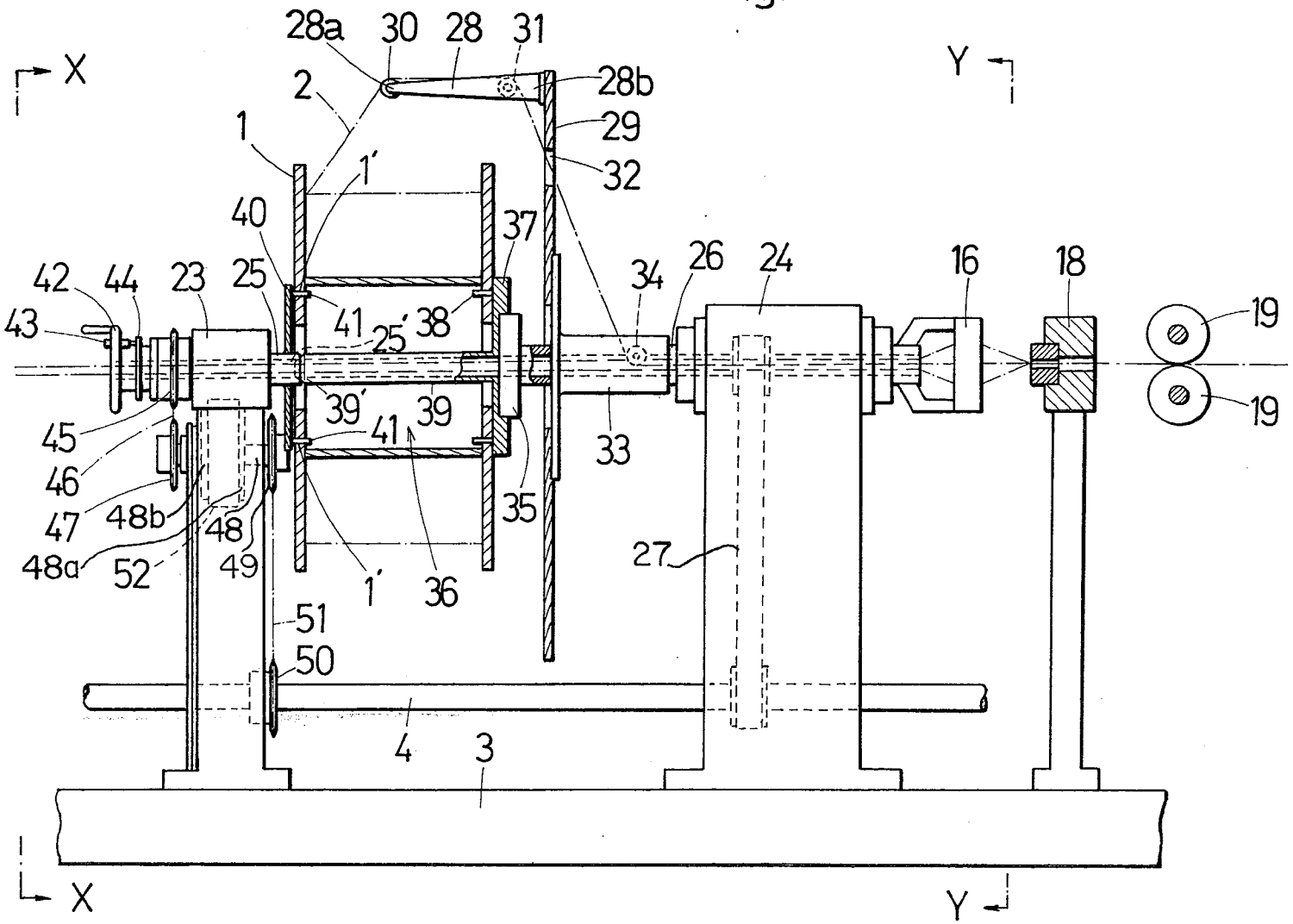
FIG. 2 is a partially cutaway front elevation view wherein some elemental parts of a drum mounting platform are shown in section.

As best shown in FIG. 2, bearing strands 23, 24 are disposed in a position to hold the drum 1 therebetween in the axial direction thereof and rotatably support rotary shafts 25, 26, respectively.

Said rotary shaft 25 on the bearing stand 23 is rotated internally of the latter by a timing belt 27 from the main shaft 4. On the periphery of said rotary shaft 25 adjacent to the drum 1 there is rigidly fixed a rotary disk 29 which has a substantially larger diameter than that of the drum 1 and is provided with an arm member 28 having the foremost end **28*a* extended over the periphery of drum 1.**

On said foremost end **28*a* and the opposite end 28*b* thereof there are supported guide rollers 30, 31 for drawing the linear object 2 from the drum 1 and guiding the same to the rotatable metallic cap 16 through a hole 32 bored in suitable position on the rotary disk 29.**

Further on a rotary boss 33 rigidly fixed to the rotary shaft 25 there is rotatably supported a guide roller 34 in a position to guide the linear object 2 through said hole 32 into the inner hollow portion 25' (shown in broken lines in FIG. 2) of the rotary shaft 25 and to the rotatable metallic cap 16.

The rotary shaft portion 25 adjacent to one side of the drum 1 is provided with a one-way clutch wheel 35 arranged to prevent the drum 1 from rotating faster than the rotary plate 29 due to the difference in weight therebetween when the drum 1 stops rotating. To said clutch wheel 35 is mounted the outer surface of a head portion 37 of a metallic fixture means 36 mounting the drum 1 to the rotary shaft 25 while the inner surface of said head portion 37 is circumferentially provided with a plurality of pins 38 fixedly mounting one side of the drum 1 to the head portion 37.

Shaft member 39 of said metallic fixture means 36 is internally hollowed with one end 39' supported on the rotary shaft 25 which is also internally hollowed with one end 25' situated in adjacency to the drum 1 and having a disk 40 fixed thereon.

One side of said disk 40 adjacent to the drum 1 is provided circumferentially with a plurality of pins 41 so that when the rotary shaft 25 is moved toward the drum 1, the disk 40 is also moved toward the drum 1, consequently the pins 41 are engaged with the drum 1 through holes 1' bored therein.

Axial movement of said rotary shaft 25 is effected by manually moving a handle on a crank 42. A safety pin 43 is rigidly fixed to said handle 41 in engageable relation with a plate 44 so that when the safety pin 43 is engaged with the plate 44, said rotary shaft 25 is prevented from moving further in an axial direction.

Due to the above-mentioned arrangement, said plurality of pins 41 are prevented from disengaging the drum 1.

A first pulley member 45 rigidly fixed to the rotary shaft 25 rotatably supported on the bearing stand 23 is drivingly connected through a first timing belt 46 to a second pulley member 47 rigidly fixed to the output portion **48*a* of a magnetic clutch 52 in shaft 48. Said magnetic clutch 52 used herein is a mechanism of such known type that metallic powder between the input portion 48*a* and the output portion 48*b* whereby when energized with an electric current, the powder is magnetized to transmit a driving torque to the output portion 48*b* from the input portion 48*a*.**

According to the present embodiment, the rotary plate 29 driven to the rotary shaft 25 is adapted to begin rotating a little earlier than the drum 1 connected to the rotary shaft 26 so that the rotational speed of the rotary shaft 26 is almost equal to the quantity of linear object 2 drawn out of the drum 1.

The mechanical arrangement is such that when the linear object 2 guided to the rotary boss 33 of each preceding drum assembly is fed into the inner hollow portion 25' of the rotary shaft 25, it is drawn out by means of the rotatable metallic cap 16 through the inner hollow portions 42' of the handles 42 equipped on the preceding drums, the inner hollow portion 25' of the rotary shaft 25, the inner hollow portion 36' of the rotatable metallic fixture means 36 and the inner hollow portion 26' of the rotary shaft 26, all being as described.

The rotatable metallic cap 16 is connected to one end of the rotary shaft 26 and rotated by the movement thereof to effect the twisting operation of the linear objects 2 into said continuity of rope-like object 20.

Figure 4:
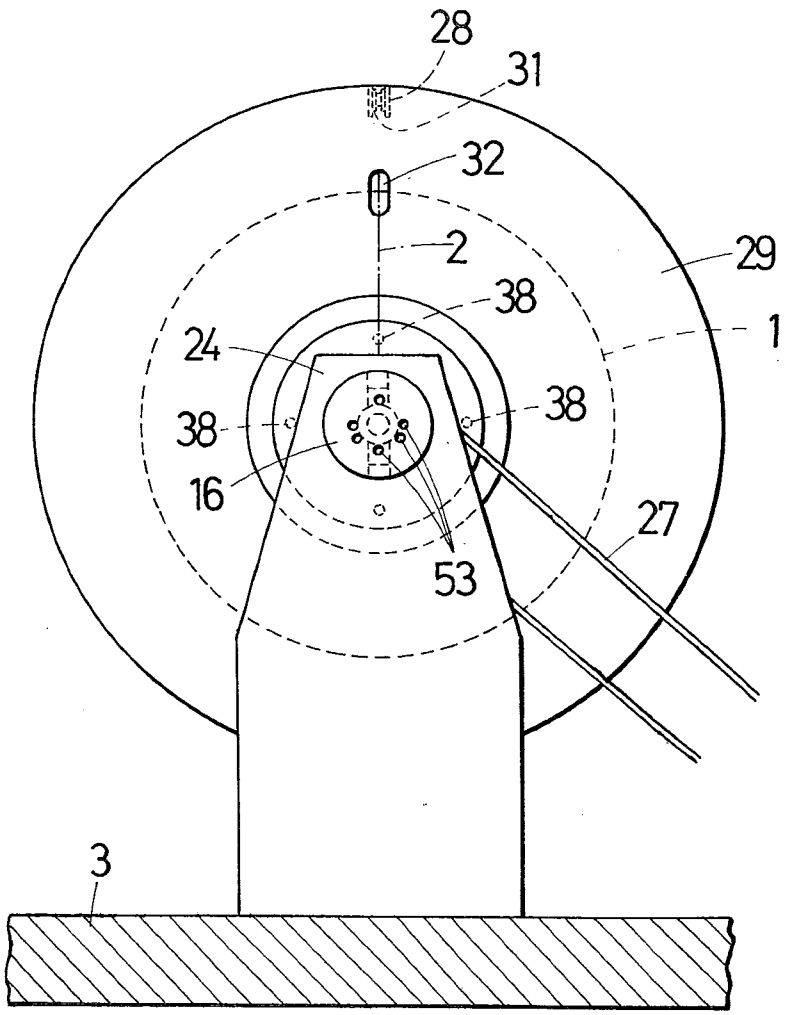
FIG. 4 is a vertical section view taken in the line Y — Y of FIG. 2.
Figure 3:
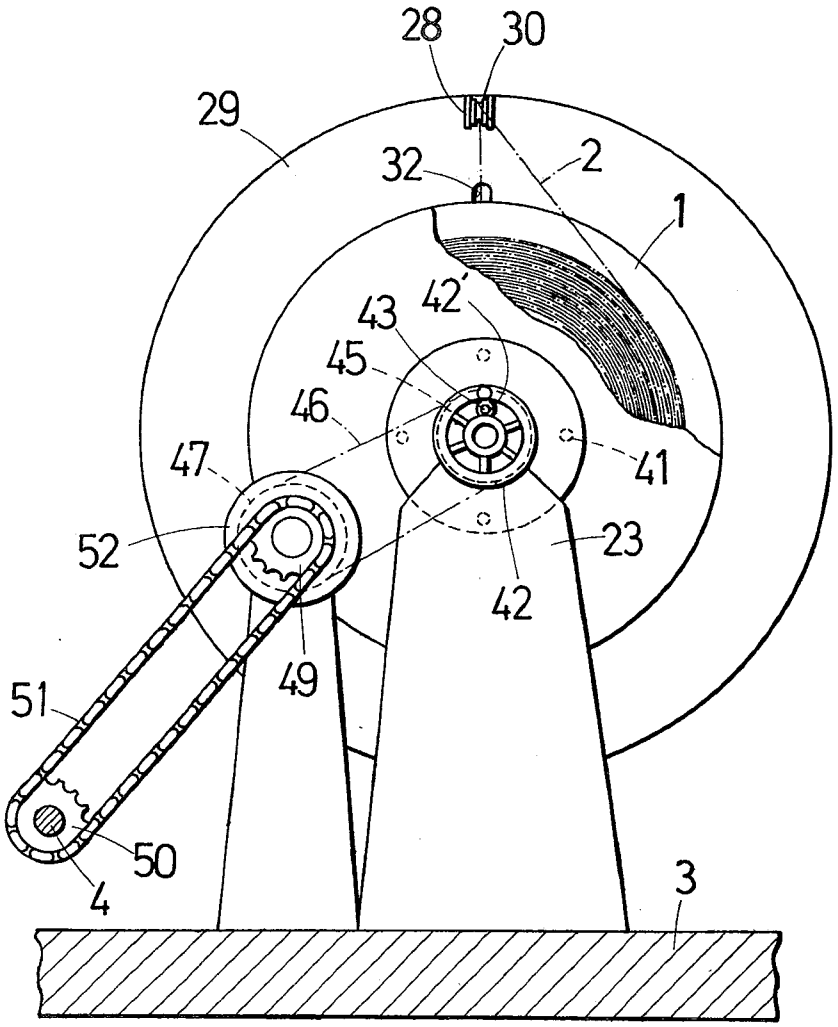
FIG. 3 is a vertical section view taken on the line X — X of FIG. 2.

Further, said rotatable metallic cap 16 is provided with a plurality of through holes 53 at equally spaced apart intervals, as clearly shown in FIG. 4 of the accompanying drawings, so that the cap 16 is applicable to any number of drums 1 in use or any number of linear objects 1 to be drawn out of these drums 1.

The following is the detailed description of the intertwisting operation effected by the twisting machine carried out in accordance with the present embodiment.

Each drum 1 is axially mounted on the rotary shafts 25, 26 of each drum assembly through the metallic fixture means 39 and the disk 40 while each linear object 2 wound on the drums 1 is guided into the inner hollow portions 25', 26' of the rotary shafts 25, 26, respectively, through the guide rollers 30, 31 of each arm member 28 and the guide roller 34 of the rotary boss, thereafter being drawn out to the rotatable metallic cap 16. The linear objects 2 thus drawn out are fed into said through holes 53, respectively, and then brought together into the fixed metallic cap 18.

The collected linear objects 2 are wound several times on the outer periphery of the drawing drum 12 with the foremost end fixedly held on said winding drum 21. When the motor 6 starts to rotate the main shaft 4, the drum 1, the rotary plate 29, the rotatable metallic cap 16 and the drawing drum 12 also start to rotate at a pre-determined rotary speed ratio. Thus, the linear objects 2 are drawn out from each drum 1 by means of the drawing drum 12 and fed through the rotary plate 29 and the rotary boss 33. Thus, the linear objects 2 are prevented from being distortedly twisted when intertwisted through the rotatable metallic cap 16.

As is clearly evident from the foregoing description, a plurality of linear objects 2 are twisted together to form a continuity of rope-like object 20 by movement of the rotatable metallic cap 16.

However, if each of these objects 2 is given an irregular tension, they would not be formed at a uniform angle of twist. The tension of each linear object 2 is adjusted by regulating the amount of a driving force transmitted by means of the magnetic clutches 52. For a fuller understanding, if the magnetic coherence of attraction of metallic power in the clutch 52 is weak, slippage is permitted in the clutch, thus giving rise to weak tension of the linear objects 2. On the contrary, if said magnetic coherence of attraction is strong, less slippage is permitted so that the tension of the linear objects 2 is also strong.

Accordingly, it follows from this that each magnetic clutch 52 is able to control the movement of the drum 1 so that the tension of all the linear objects 2 can be made uniform merely by regulating the magnetic clutches 52 whereby said plurality of linear objects 2 can be intertwisted at a uniform angle of twist to form said continuity of rope-like object 20.

If a greater number of drums 1 need to be applied to the twisting machine A of the invention in order to increase the number of linear objects 2 to be twisted together, additional drum assemblies may be mounted on the Machine A in a position wherein the rotary shafts 25, 26 are disposed axially in alignment with each other.

In the above-described embodiment, the twisting machine A of the invention is so constructed so that the drum assemblies are all placed in axial alignment with each other. However, according to another embodiment, the drum 1 at the end opposite to the rotatable metallic cap 16 may be disposed in a position axially transverse with respect to the remaining drums 1 whereby the linear object 2 drawn out from said particular drum 1 is directly fed into each inner hollow portion 25' of the remaining shafts 25 so as to be fed to the rotatable metallic cap 16.

By the above-mentioned arrangement, the rotary plate 29, the arm members 28 and the guide rollers 30, 31 and 34 may be all omitted.

Further in case such a linear object 2, for example, as hemp yarn is to be twisted together with other kind of linear objects 2, a single drum assembly may be enough. However, even if the hemp yarn is equal in length to said other linear objects 2, it is smaller in diameter than, and lighter in quality than, the latter objects 2. Thus in such cases, said drum 1 wound with the hemp yarn is rotatably supported on the rotary shaft 25 adjacent to the rotatable metallic cap 16 through a suitable drum supporting means (not shown in the accompanying drawings). Thereafter the hemp yarn is fed into the inner hollow portion 25' of the rotary shaft 25 and further fed into the rotatable metallic cap 16 thereby twisting the hemp yarn together with said other linear objects with uniform tension.

Though a few specific embodiments of the present invention has been shown and described herein, it will be apparent to those skilled in the art that the invention is not restricted to the details set forth but many changes and modifications may be made without departing from the spirit and scope of the invention as defined in the annexed claims.

What is claimed:

1. A twisting machine for intertwisting linear objects comprising drums wound with said linear objects, rotary shaft means for rotatably supporting said drums, a main shaft disposed in parallelism with said rotary shaft means, means for drivingly connecting said main shaft and each of said rotary shaft means, arm members each disposed over the outer periphery of said drums and rotatable about the axis thereof to draw out said linear objects from said drums, guide means for guiding said drawn linear objects into an axially inner hollow portion of said rotary shaft means, a twisting means for intertwisting said guided linear objects at a uniform angle of twist thereby to form a continuity of thick, strong rope-like object, and a means for winding thereon said continuity.

2. The twisting machine, as set forth in claim 1, comprising a. a plurality of rotary shaft means having relatively rotatable portions disposed in parallel relation with said main shaft, b. connecting means for drivingly connecting said main shaft to each of said rotary shaft means, c. a metallic fixture means for rigidly fixing said drum to one portion of said rotary shaft means, d. there being the same number of drums as said rotary shaft means, each being rigidly fixed to the said portion of said shaft means and wound on the outer periphery thereof with said linear object, e. said inner hollow portion extending axially of said rotary shaft means, f. bearing stands for rotatably supporting said rotary shaft means, g. a rotary plate rigidly fixed to the other portion of said rotary shaft means in adjacency to one side of said drum, h. a rotary boss having an axially inner hollow portion and rigidly fixed to said other portion of said rotary shaft between said shaft and said bearing stand, i. a guide roller means mounted in said inner hollow portion, j. an arm member extending over the outer periphery of said drum from the edge of said rotary plate in substantially perpendicular relation thereto, k. at least two guide rollers mounted on the foremost end of said arm member and in the adjacency to the other end opposite thereto, l. a through hole bored on said rotary plate in a linear position from said other end to said guide roller mounted in the inner hollow portion of said rotary boss, m. a rotary cap means rigidly fixed to one end of said rotary shaft, n. a plurality of through holes bored on said rotary cap means circumferentially at regularly spaced apart intervals, said linear objects fed from said drums being twisted together through said holes, o. a fixed cap means mounted independently of said rotary cap means in axially aligned relation therewith, said linear objects being formed into a continuity of thick, strong rope-like object and fed into a center hole of said fixed cap means, p. at least a pair of feed rollers rotatably supported in axially aligned relation with said center hole independently of said fixed cap means, q. a drawing drum for drawing said rope-like object, having the outer periphery disposed in axially aligned relation with said center hole, r. a shaft means for rotatably supporting said drawing drum, and s. a reduction gear mechanism supported on said shaft means and adapted to transmit a torque from said motor to said shaft means.

3. The twisting machine, as set forth in claim 1, comprising a. a fixture means having a center hole by which said fixture means is fixed to said rotary shaft means, b. a plurality of spaced axial holes bored through said fixture means, c. a plurality of through holes bored on one side of said drum in positions corresponding to said through holes of said fixture means, d. fastener means inserted into said through holes of said drum and said fixture means, e. a clutch wheel fixed to said fixture means, being rotatable at one direction only so as to prevent the drum from being inertially rotated when the fixture means stops rotating, f. a plurality of through holes bored on the other side of said drum, g. a discoidal plate rigidly fixed to said rotary shaft means in adjacency to said other side, h. a plurality of pins extending from said discoidal plate in positions corresponding to said through holes of said drums, i. said drum being disengageable with respect to said bearing stand composed of said fixture means, said fastener means, said discoidal, plate and said pins, j. a crank means mounted on the end of said rotary shaft means in adjacency to said discoidal plate and manually operable to move said rotary shaft means in an axial direction thereby engaging said pins into said through holes bored on said other side of the drum, k. a safety pin operably mounted on said crank, and l. a fixing plate rigidly fixed close to said end of the rotary shaft means and engageable with said safety pin so as to prevent said crank from moving reversely and further prevent said discoidal plate from disengaging from said drum.

4. The twisting machine, as set forth in claim 3, comprising a. a first pulley means fixed to a rotary shaft portion adjacent said discoidal plate, b. a connecting means mounted on said first pulley means, c. a second pulley means movably connected to said first pulley means through said connecting means, d. a shaft means fixedly supporting said second pulley means, e. a magnetic clutch means mounted on said shaft means, being provided with elements magnetically connectable with one another when metallic powder put thereon is electrified, f. a third pulley means fixed to the end of said shaft means opposite to said second pulley means, g. a connecting means mounted on said third pulley means, h. a fourth pulley means movably connected to said connecting means and fixed to said main shaft so as to transmit the rotation of the latter shaft to said rotary shaft means through said magnetic clutch, whereby to provide for adjusting the driving force transmitted from said fourth pulley means to said third pulley means thereby providing for regulating the tension of the linear object wound on said drum.

5. The twisting machine, as set forth in claim 1, including a. a drawing drum for drawing said continuity of rope-like object from said drums having at least an outer peripheral portion thereof disposed in axial alignment with said rotary shaft means and fixed to a shaft means extending transverse to the axis thereof, b. a large diameter gear rigidly fixed to an end of said shaft means opposite to said drawing drum, c. a small diameter gear intermeshingly engaged with said large diameter gear, d. a second reduction gear mechanism connected to said small diameter gear so as to transmit a driving force to said latter gear, e. a winding drum for winding said continuity from said drawing drum, having at least an outer peripheral portion thereof disposed in a position axially of said outer peripheral portion of said drawing drum and fixed to a shaft means, and f. a driving source independently mounted to rotate said winding drum through said shaft means.

* * * * *

UNITED STATES PATENT OFFICE

CERTIFICATE OF CORRECTION

Patent No. 4,015,415 Dated April 5, 1977

Inventor(s) Shoji Othuki et al.

It is certified that error appears in the above-identified patent and that said Letters Patent are hereby corrected as shown below:

On the Title Page, Item [76] should read:

--- Inventors: Shoji Othuki, 25, 10-Branchi, ---.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*